US009605428B2

(12) United States Patent
Fladeland et al.

(10) Patent No.: US 9,605,428 B2
(45) Date of Patent: Mar. 28, 2017

(54) CEILING PANEL FOR USE WITH CONCEALED GRID SYSTEM

(71) Applicant: Rockwool International A/S, Hedehusene (DK)

(72) Inventors: Mark A. Fladeland, Bolingbrook, IL (US); Michael Corpolongo, Chicago, IL (US); Brett Christeon, Frankfort, IL (US); Scott G. Jankovec, Elmhurst, IL (US); William R. Wuetig, Schereville, IN (US)

(73) Assignee: Rockwool International A/S, Hedehusene (DK)

( * ) Notice: Subject to any disclaimer, the term of this patent is extended or adjusted under 35 U.S.C. 154(b) by 102 days.

(21) Appl. No.: 14/635,101

(22) Filed: Mar. 2, 2015

(65) Prior Publication Data

US 2016/0208488 A1 Jul. 21, 2016

Related U.S. Application Data

(60) Provisional application No. 62/103,694, filed on Jan. 15, 2015.

(51) Int. Cl.
*E04B 9/04* (2006.01)
*E04B 9/22* (2006.01)
(Continued)

(52) U.S. Cl.
CPC ..... *E04B 9/0428* (2013.01); *E04B 9/0478* (2013.01); *E04B 9/225* (2013.01);
(Continued)

(58) Field of Classification Search
CPC . E04B 9/00; E04B 9/04; E04B 9/0407; E04B 9/0428; E04B 9/0435; E04B 9/0464;
(Continued)

(56) References Cited

U.S. PATENT DOCUMENTS 3,740,916 A 6/1973 Kenaga
3,977,144 A * 8/1976 Jahn ..... E04B 9/241 52/664
(Continued)

FOREIGN PATENT DOCUMENTS

DE 23 53 231 A1 5/1975
DE 90 00 698 U1 4/1990
(Continued)

OTHER PUBLICATIONS

Patent Cooperation Treaty, from the International Search Authority, International Search Report for International Application No. PCT/US2015/018242, Applicant: Chicago Metallic Company LLC completed on Aug. 12, 2015, mailed Aug. 19, 2015.
(Continued)

*Primary Examiner* — Jessica Laux
(74) *Attorney, Agent, or Firm* — Cook Alex Ltd.

(57) ABSTRACT

A metal panel configured to be supported in a suspension ceiling grid is provided comprising a metal sheet with a central planar portion and upturned edges defining a plurality of sides of the panel. The upturned edges comprise a first, generally-upwardly extending portion sharing a common edge with the central planar portion, a second, generally horizontally portion extending inwardly from and sharing a common edge with the first portion, and a third, generally downwardly extending portion sharing a common edge with the second portion, the first, second and third portions of the edges defining downwardly-opening channels. At least one cross brace is provided that extends between at least two sides of the panel, the cross brace having ends configured to be received in the channels. The central planar portion of the panel is secured to the cross brace to limit deflection of the central portion.

13 Claims, 8 Drawing Sheets

(51) Int. Cl.
*E04C 2/08* (2006.01)
*E04C 3/02* (2006.01)

(52) U.S. Cl.
CPC ..... *E04B 2103/06* (2013.01); *E04C 2/08* (2013.01); *E04C 2003/026* (2013.01)

(58) Field of Classification Search
CPC ..... E04B 9/0478; E04B 9/0485; E04B 9/06; E04B 9/065; E04B 9/067; E04B 9/18; E04B 9/205; E04B 9/225; E04B 9/242; E04B 2103/06; E04C 2003/026; E04C 2/108
See application file for complete search history.

(56) References Cited

U.S. PATENT DOCUMENTS 4,438,613 A 3/1984 Hintsa et al.
5,428,930 A 7/1995 Bagley et al.
6,971,210 B2 12/2005 Kliegle et al.
7,730,690 B2 * 6/2010 Miller ..... E04B 9/18 248/333
8,316,607 B2 * 11/2012 Eisner ..... E04B 9/0478 52/506.01
8,683,768 B2 4/2014 Gerkes et al.
8,745,947 B2 * 6/2014 Jahn ..... E04B 9/0478 52/483.1
9,187,896 B1 * 11/2015 Bergman ..... E04B 9/06
2007/0193131 A1 * 8/2007 Ortiz ..... E04B 9/0435 52/144
2011/0252735 A1 * 10/2011 Eisner ..... E04B 9/0478 52/506.05
2012/0137615 A1 * 6/2012 Wendt ..... E04B 9/003 52/506.07
2013/0214118 A1 8/2013 Jeswani et al.

FOREIGN PATENT DOCUMENTS

DE 91 02 266 U1 5/1991
DE 295 16 326 U1 12/1995
FR 2 768 758 A1 3/1999

OTHER PUBLICATIONS

Patent Cooperation Treaty, from the International Search Authority, Written Opinion of the International Searching Authority for International Application No. PCT/US2015/018242, Applicant: Chicago Metallic Company LLC completed on Aug. 12, 2015, mailed Aug. 19, 2015.

* cited by examiner

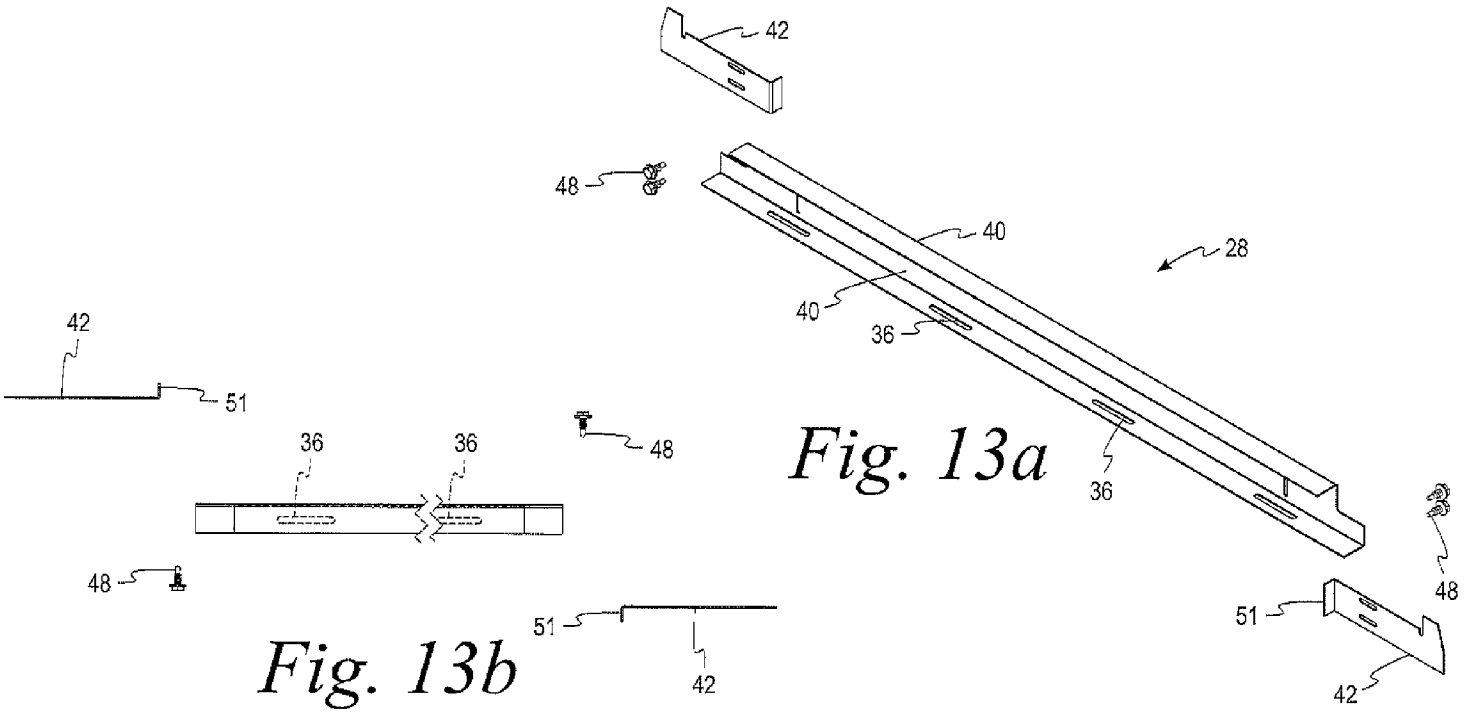
Fig. 13a
Fig. 13b
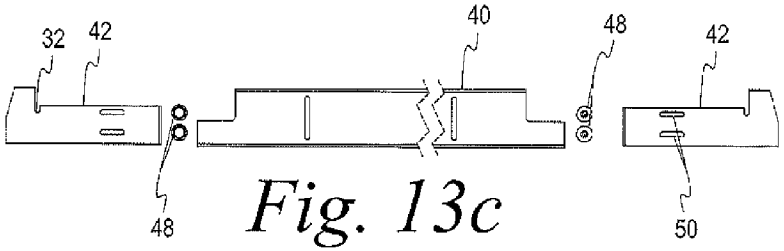
Fig. 13c
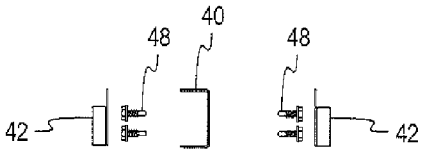
Fig. 13d

CEILING PANEL FOR USE WITH CONCEALED GRID SYSTEM

FIELD OF THE DISCLOSURE

The present disclosure relates to a ceiling panel for use with a concealed grid panel and, more particularly, a concealed grid system ceiling panel configuration suitable for use in a large format grid system.

BACKGROUND

It is known in the context of a concealed grid ceiling system to use panels that are secured to the suspension system by, e.g., torsion springs, so that the ceiling panels abut to hide the grid network. The torsion springs support the panel at a first position spaced below the grid system, with the panels being movable to a second position with the panels being maintained in tight engagement with the lower surface of the grid network by the torsion springs. Typically, the panels comprise a fibrous, acoustical-dampening material, such as mineral wool or cellulose, with the panels being mounted in a metal frame that engages the panel edges. See, e.g., U.S. Pat. No. 8,683,768, U.S. Pat. No. 6,971,210, U.S. Pat. No. 5,428,930, and U.S. Pat. No. 4,438,613.

The present disclosure is directed to a ceiling panel for use in a concealed grid ceiling system that is made of relatively thin metal sheet, and is particularly suited for producing large format (i.e., larger than 24"×48" nominal in at least one dimension) panels.

BRIEF DESCRIPTION OF THE DRAWINGS

The features of the present subject matter are described in the following detailed description and shown in the attached figures, of which.

DETAILED DESCRIPTION

Figure 1:
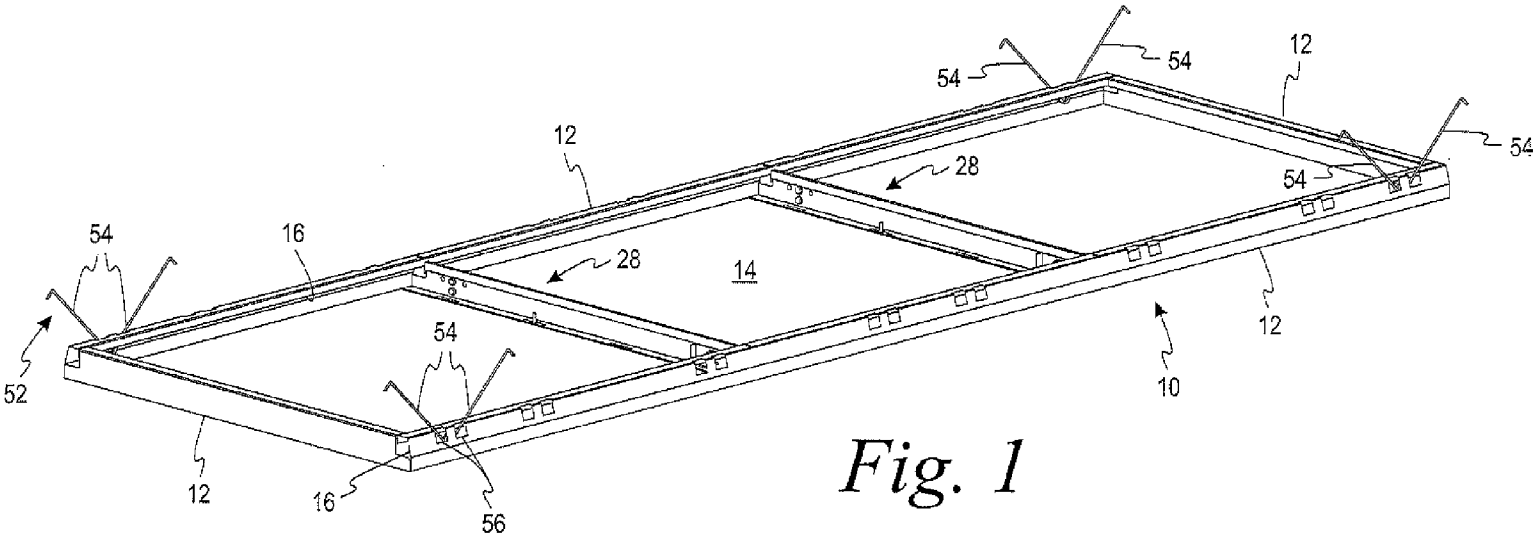
FIG. 1 is a perspective view of a ceiling panel in accordance with the present disclosure.

A more detailed description of the ceiling panel in accordance with the present disclosure is set forth below. It should be understood that description below of a specific embodiment is intended to be exemplary, and not exhaustive of all possible variations or applications. Thus, the scope of the disclosure is not intended to be limiting, and should be understood to encompass variations or embodiments that would occur to persons of ordinary skill.

Turning to the figures of the drawings, there is seen a ceiling panel, generally indicated 10, in accordance with the present disclosure. The major portion of the panel 10 is formed from a metal sheet material, such as aluminum or steel alloy, having a thickness on the order of 0.40". While the panel illustrated in the drawings is rectangular in configuration, it may be of any shape having a plurality (three or more) generally rectilinear sides (e.g., triangular, pentagonal, hexagonal, etc.) without departing from the scope of the disclosure.

The metal sheet is converted into a ceiling panel 10 by folding the sheet along its edges to form a plurality of sides 12, each having an upwardly-extending edge configuration that define a central, substantially planar portion 14 of the panel 10. If desired, the central portion 14 of the panel 10 may receive a backer board or insert (not shown) made of, e.g., an acoustically-dampening material that is supported on the upper surface of the panel 10.

Figure 2:
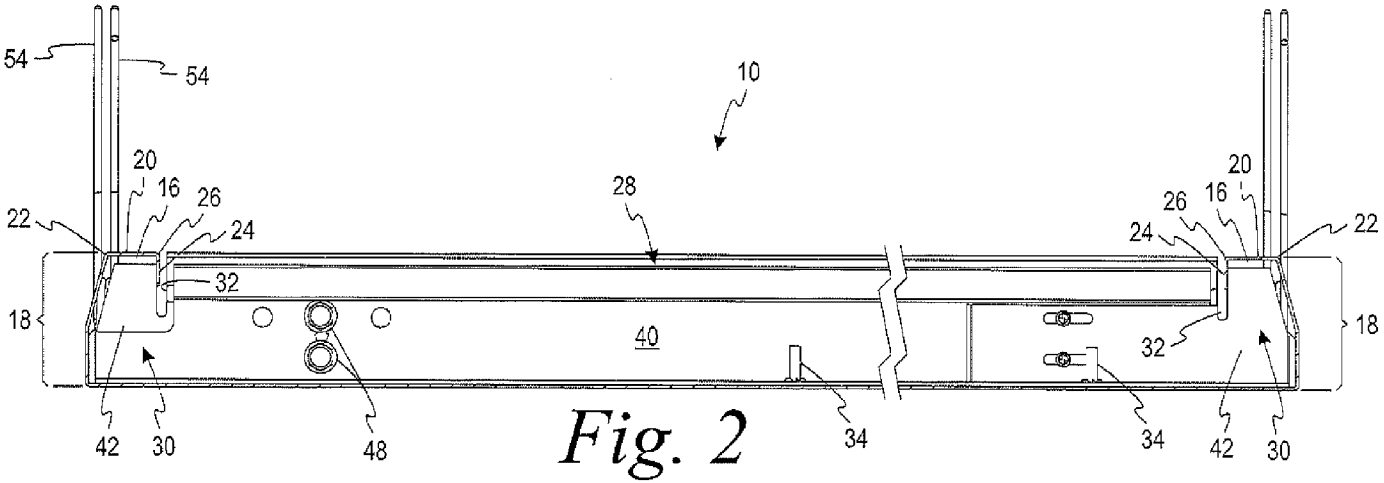
FIG. 2 is a fragmentary end view of the ceiling panel of FIG. 1.
Figure 3:
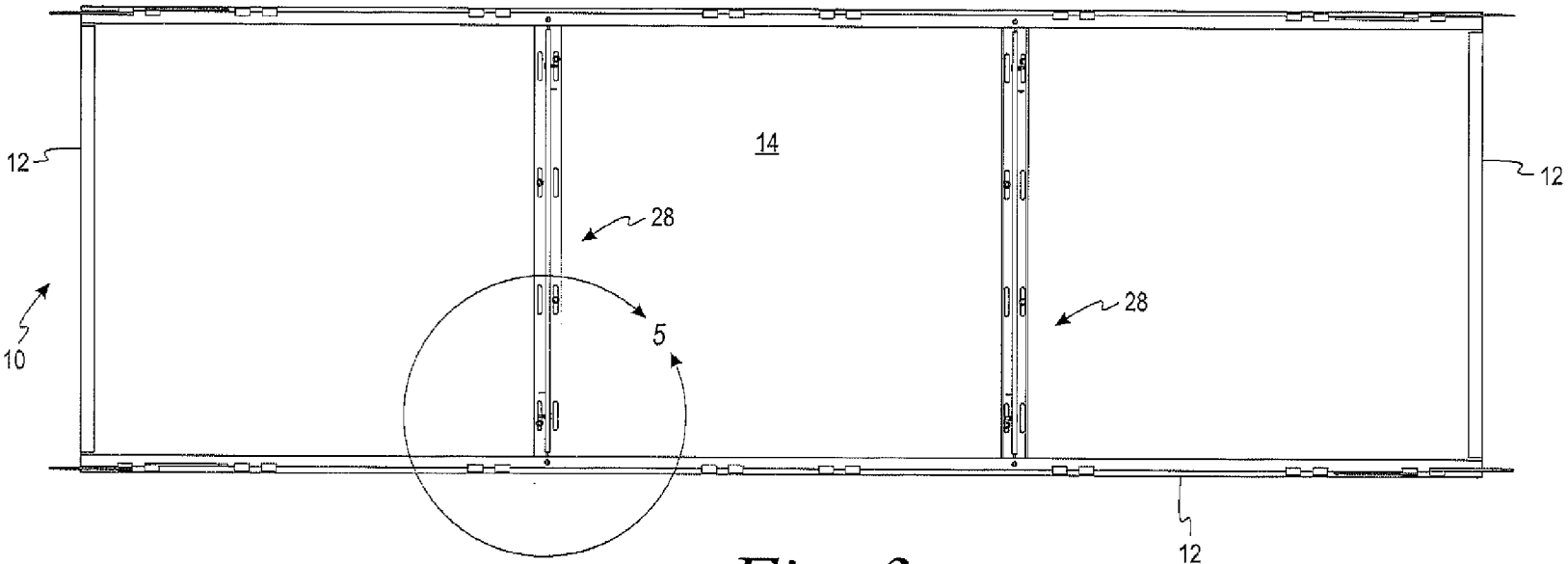
FIG. 3 is a top view of the ceiling panel of FIG. 1.
Figure 4:
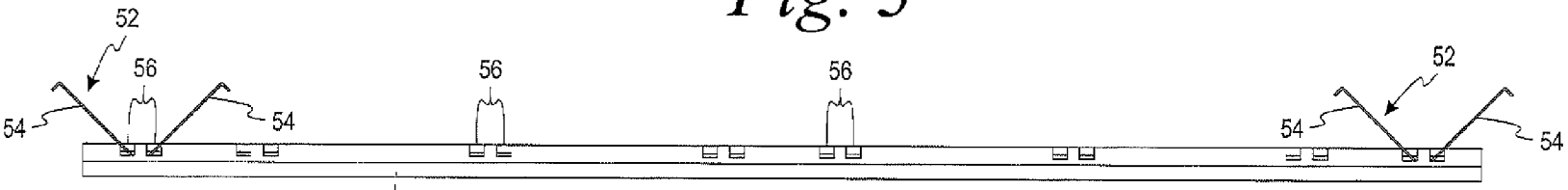
FIG. 4 is a side view of the ceiling panel of FIG. 1.
Figure 6:
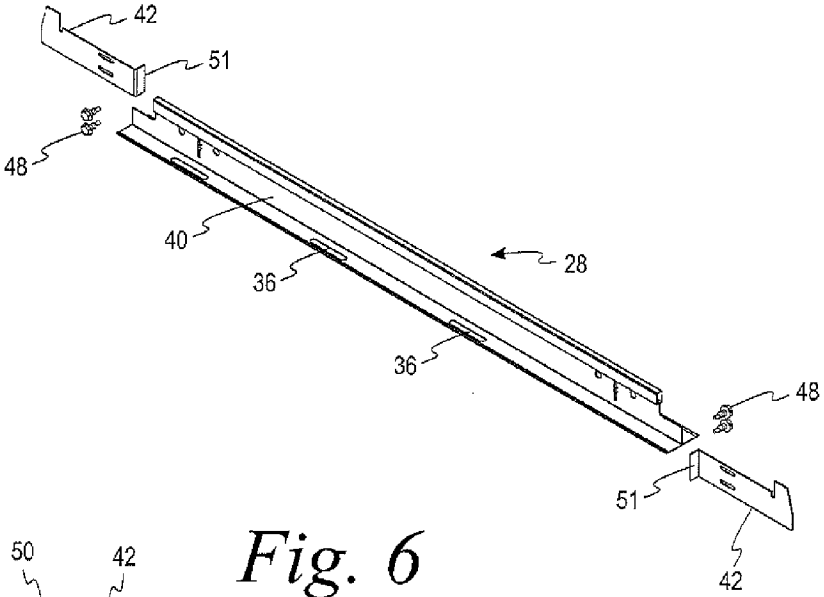
FIG. 6 is an exploded perspective view of a cross brace forming part of the ceiling panel of FIG. 1.
Figure 5:
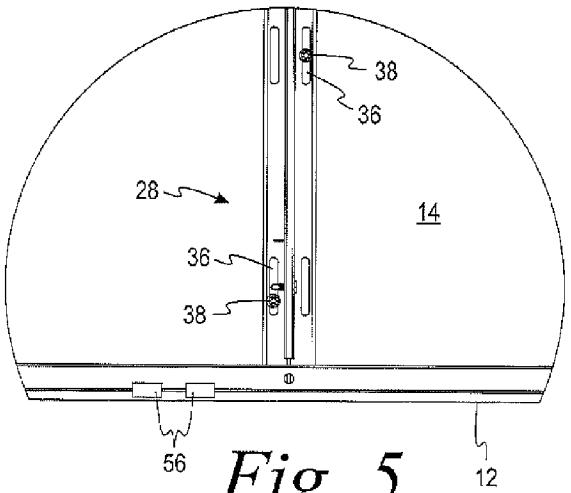
FIG. 5 is a fragmentary top view of the ceiling panel of FIG. 4 enlarged to show detail.
Figure 7:
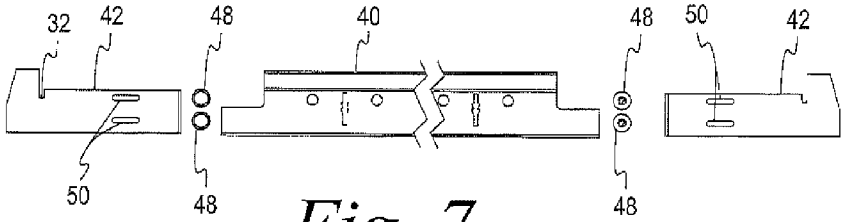
FIG. 7 is an exploded side view of the cross brace of FIG. 6.
Figure 8:
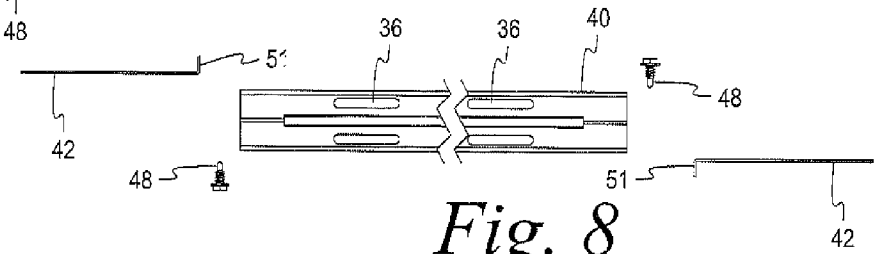
FIG. 8 is an exploded top view of the cross brace of FIG. 6.
Figures 9, 10:
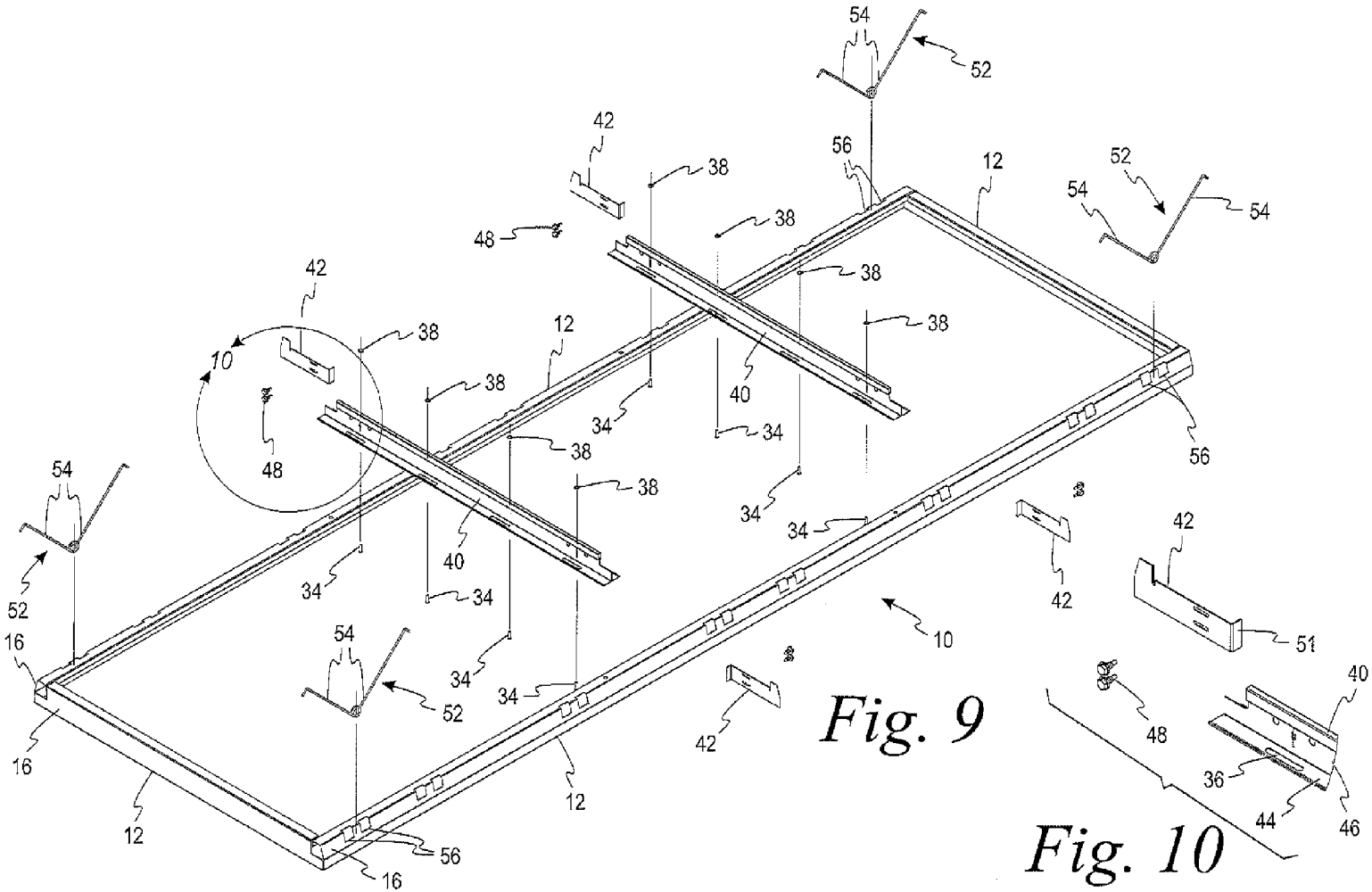
FIG. 9 is an exploded perspective view of the ceiling panel of FIG. 1.
FIG. 10 is an exploded perspective view of an end of a cross brace taken form FIG. 9 and enlarged to show detail.
Figure 11A:
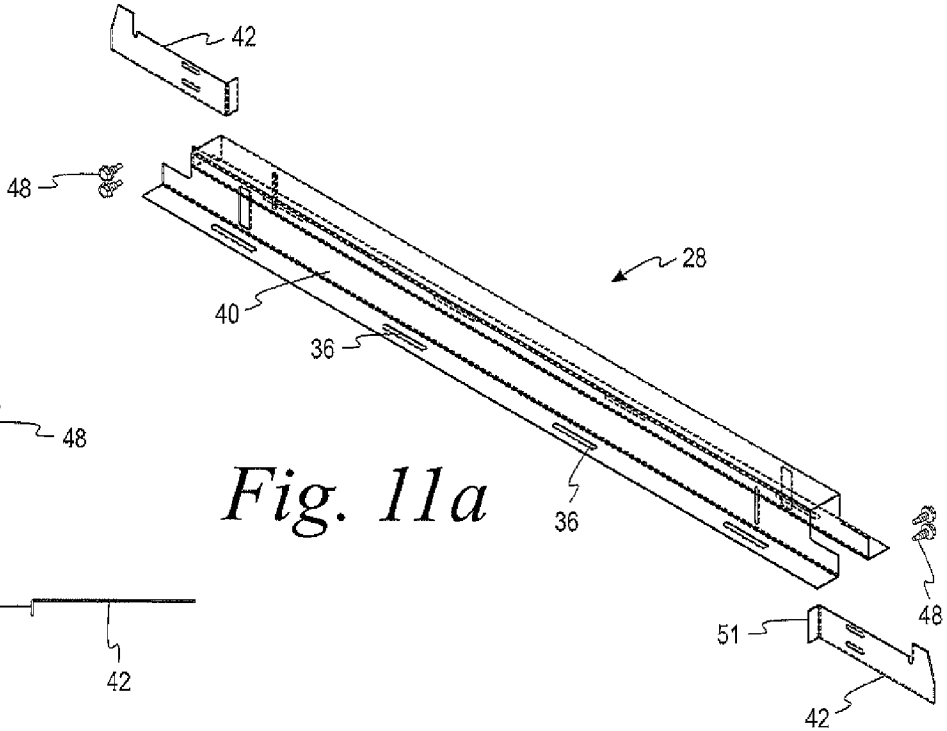
FIGS. 11*a-d* through 14*a-d* are exploded perspective, top, side, and end views showing alternative configurations for the elongated portion of the cross brace.
Figure 11B:
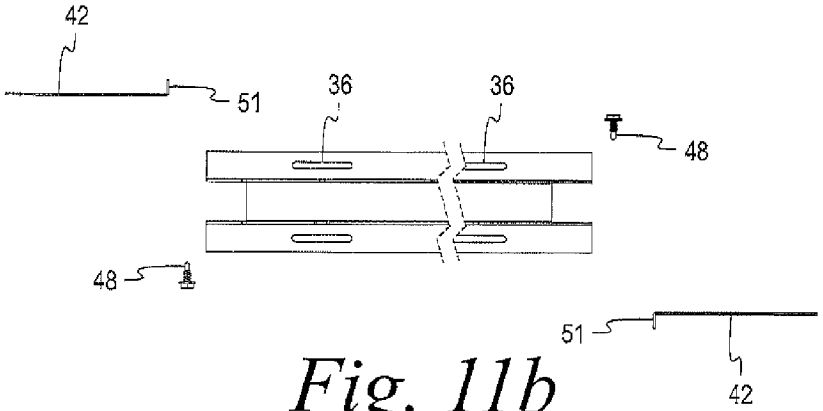
Figure 11C:
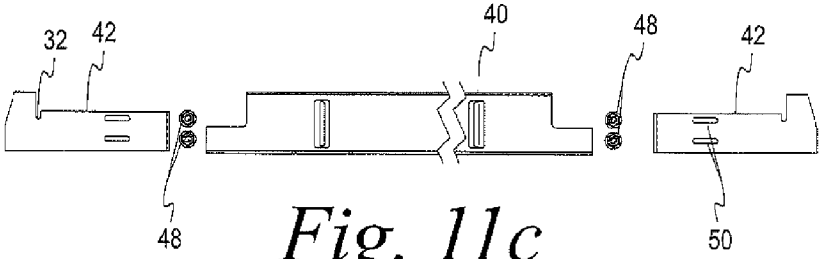
Figure 11D:
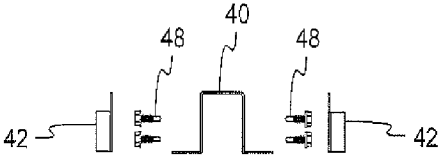
Figures 12A, 12B, 12C, 12D:
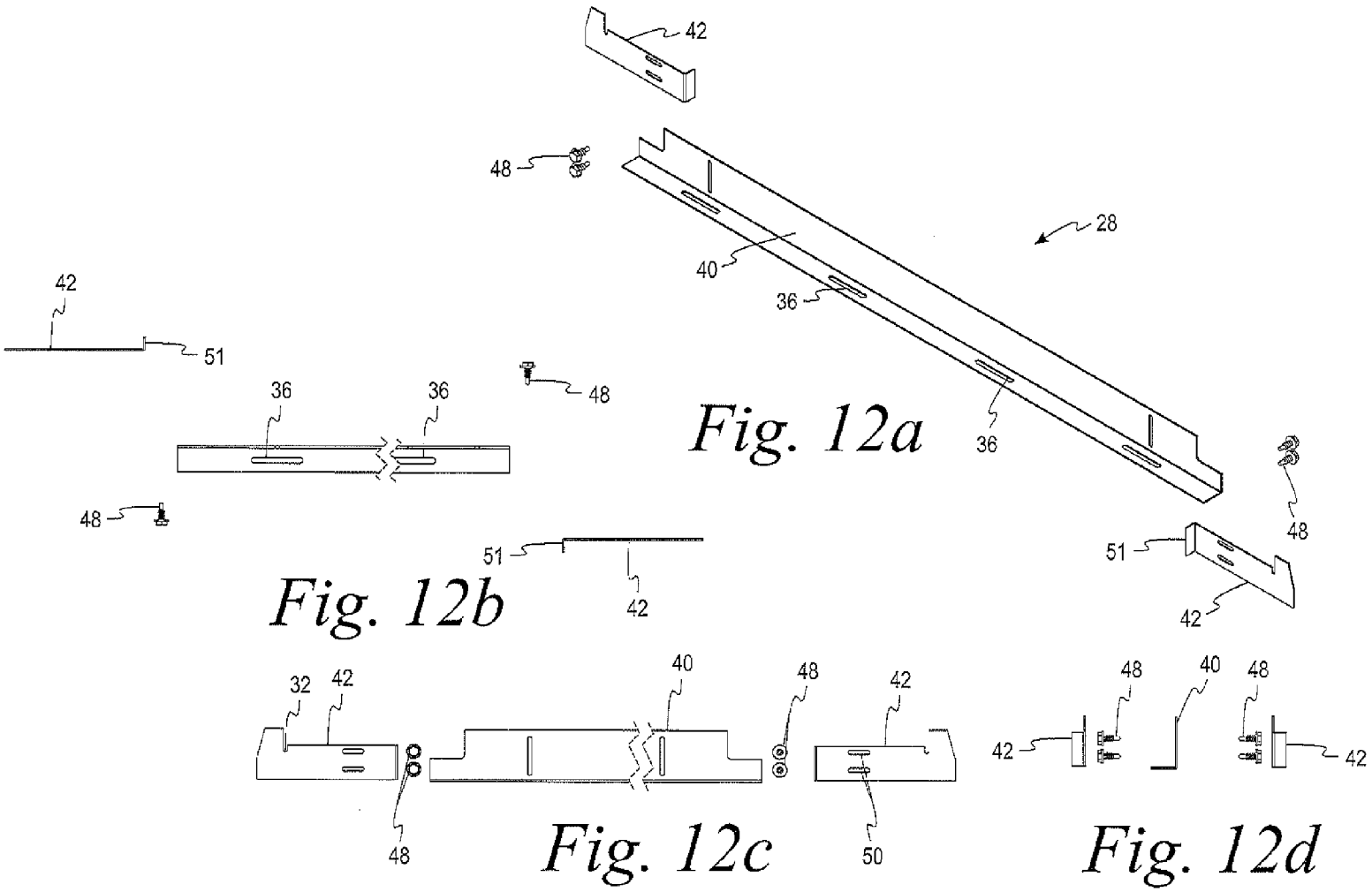
Figure 14A:
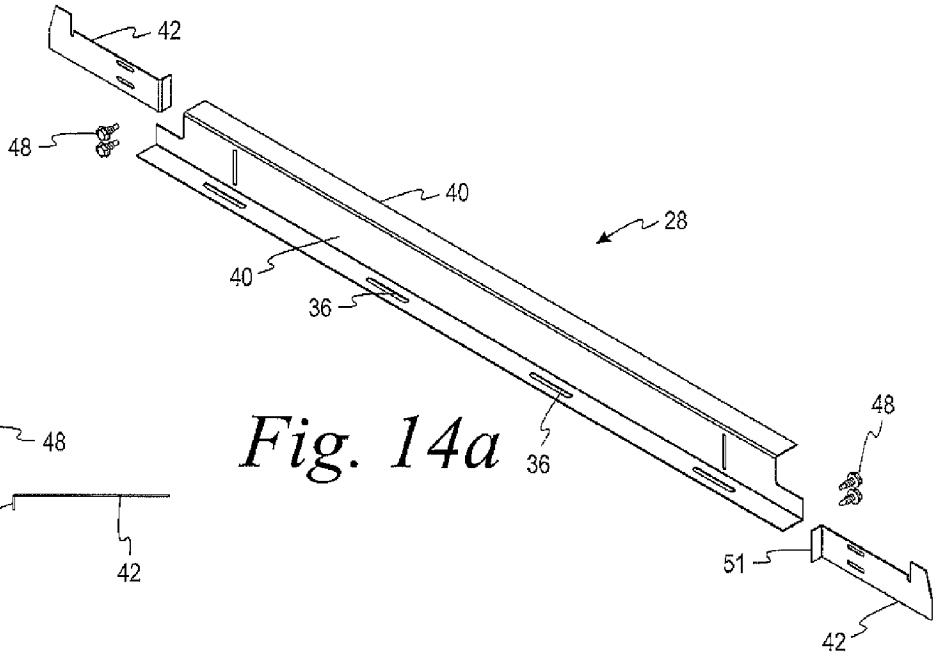
Figure 14B:
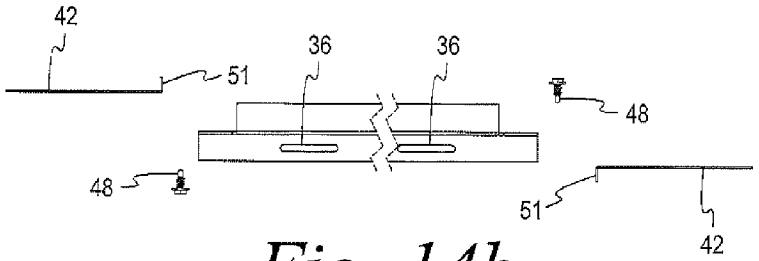
Figure 14C:
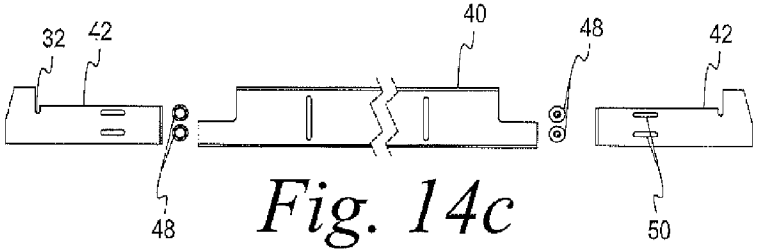
Figure 14D:
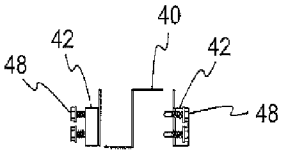

As best seen in FIG. 2, the upwardly extending edges 12 each define a downwardly opening channel 16. More specifically, the channel 16 in the edges 12 is defined by a first, generally-upwardly extending portion 18, a second, generally-transversely or horizontally extending top portion 20 that extends inwardly from and shares a common edge 22 with the first portion 18, and a third, generally-downwardly extending portion 24 that shares a common edge 26 with the second portion 20.

As illustrated, the first portion 18 of each channel 16 has an inward bend so that the top portion 20 of the channel 16 is spaced somewhat inwardly from the outer edge of the panel 10 in order to facilitate installation of the panel.

In keeping with one aspect of the disclosure, the ceiling panel 10 includes at least one cross brace 28 that extends between two sides 12 of the panel 10 and includes ends 30 configured to be received in the channels. In the illustrated embodiment, the ends 30 of the cross brace 28 have a shape complementary to a cross section of the channel 16 in which it is received, and includes a slotted portion 32 that receives the third, downwardly-extending portion 24 of the channel 16.

In keeping with a further aspect of the disclosure, the cross brace 28 comprises a rigid, central portion 40 with separately-formed attachment clips 42 that are secured thereto and which define the ends 30 of the cross brace 28 that are received in the channel 16. The central portion 40 is preferably roll formed of a metallic material and, in the embodiment of FIGS. 1-10, has a generally inverted Tee-shaped cross section, with opposed flanges 44 at its lower end for engaging the upper surface of the ceiling panel 10 and an upwardly-extending web 46 to which the attachment clips 42 are secured. However, the central portion 40 may comprise other cross sectional shapes without departing from the scope of the disclosure, such as a hat channel (FIGS. 11*a-d*), an L-angle (FIGS. 12*a-d*), a C-channel (FIGS. 13*a-d*), and a Z-channel (FIGS. 14*a-d*), etc.

As noted above, the attachment clips 42 are formed separately from the central rigid member 40 to facilitate assembly of the panel 10, at which time the attachment clips 42 are inserted into the channels 16 and secured to the rigid member 40. With reference to, e.g., FIGS. 6-14, the attachment clips 42 are secured to the upwardly-extending web 46 of the Tee-shaped rigid member 40 by self-drilling screws 48 received in elongated slots 50 in the attachment clips 42, the slots 50 permitting some limited adjustment of the positioning of the attachment clips 42 to the rigid member 40.

However, other means for securing the attachment clips 42 to the rigid members 40 as are well known in the art may be utilized. In addition, the clip 42 may include a short leg 51 disposed generally perpendicularly to the main portion of the clip, the short leg 51 being sized to be received in a slot in the central rigid member 40 to facilitate installation of the clip.

In order to minimize any downward deflection of the central planar portion 14 of the panel 10, it is secured to the cross brace 28 by any one or more attachment means, including mechanical fasteners, welding (e.g., spot welding), and adhesives. As illustrated, the central portion 14 of the panel has a series of upstanding studs 34 secured (by. e.g., welding) thereto that are received in apertures or slots 36 in the cross braces 28 and secured thereto by nuts 38. Alternatively, the free ends of the studs 34 could be deformed (by, e.g., bending or peening), welded to the cross brace, or glued to the cross brace with an adhesive. In a further alternative, the upper surface of the panel could be formed with protrusions that define slots that capture the edges of the flanges of the elongated member of the cross brace.

Depending on the size of the panel 10, multiple cross braces may be employed in which at least two of the cross braces are disposed at right angles to each other. In such a case, one, unitary cross brace may extend from one side to an opposite side of the panel, while the cross brace oriented at a right angle thereto would comprise two elongated pieces, each having an end configured to be received in the channel, and the other end having a connector to be received in the central portion of the other cross brace, much like the stab-in connector of a cross tee that is received in a main runner of a suspension system.

In order to support the panel 10 in a grid system, the illustrated panel 10 is provided with a plurality of torsion springs 52 that are secured or maintained in the channel 16 of the panel 10, the legs 54 of the torsion springs 52 extending through slots or apertures 56 formed in the channel 16 so that the legs 54 may engage the grid system, as shown and described in the above-referenced patents. Pairs of spaced slots 56 are formed along the length of the channel 16, and torsion springs 52 are selectively associated therewith, as dictated by the size and weight of the panel 10. Alternative means for securing the panel to the grid system may be employed, such as hook members that are secured to the suspension grid and having a J-shaped lower end that is received in the channel, without departing from the disclosure.

The invention claimed is:

1. A metal panel configured to be supported in a suspension ceiling grid comprising:

a) a monolithic metal sheet comprising a central planar portion and upturned edges defining a plurality of sides of the panel, the upturned edges comprising a first, generally-upwardly extending portion sharing a common edge with the central planar portion, a second, generally horizontally portion extending inwardly from and sharing a common edge with the first portion, and a third, generally downwardly extending portion sharing a common edge with the second portion, the first, second and third portions of the edges defining downwardly-opening channels;

b) at least one cross brace comprising a rigid member extending between at least two sides of the panel, the cross brace having ends comprising attachment clips secured to the rigid member, the attachment clips having an end portion with a shape complementary to a cross section of the channel so as to be configured to be received in the channels; and c) means for attachment of the central planar portion of the panel to the cross brace to limit deflection of the central portion.

2. The metal panel of claim 1 wherein the rigid member of the cross brace comprises an inverted Tee-shaped segment.

3. The metal panel of claim 2 in which the attachment clip comprises at least one slot and is secured to a web of the rigid member by a fastener received in the slot.

4. The metal panel of claim 1 wherein the cross brace comprises a Tee-shaped segment having opposed flanges and the central planar portion of the panel is secured to the flanges of the Tee-shaped segment.

5. The metal panel of claim 1 wherein the means for attachment of the central planar portion of the panel to the cross brace comprises one or more mechanical fasteners.

6. The metal panel of claim 5 wherein the mechanical fasteners comprise upwardly extending studs secured to the upper surface of the central planar portion of the panel.

7. The metal panel of claim 6 wherein the studs are secured to the cross brace by one or more of a nut, a deformation of the stud, welding, and an adhesive.

8. The metal panel of claim 1 wherein the means for attachment of the central planar portion of the panel to the cross brace comprises an adhesive.

9. The metal panel of claim 1 wherein the means for attachment of the central planar portion of the panel to the cross brace comprises welds.

10. The metal panel of claim 1 further comprising a plurality of torsion springs associated with the channels for suspending the panel from the ceiling grid.

11. The metal panel of claim 1 wherein the attachment clips comprise a main body portion and a short leg disposed generally perpendicularly to the main body and sized to be received in a slot in the rigid member.

12. The metal panel of claim 1 further comprising a backer board sized to be supported on an upper surface of the central portion of the panel, the cross brace being placed on an upper surface of the backer board.

13. The metal panel of claim 1 wherein the rigid member of the cross brace comprises one of a hat channel, an L-angle, a C-channel, and a Z-channel.

* * * * *